US009061791B2

(12) United States Patent
Cameron

(10) Patent No.: US 9,061,791 B2
(45) Date of Patent: Jun. 23, 2015

(54) BOX WITH FULL-HEIGHT SIDE SUPPORTS AND BLANK AND PROCESS FOR FORMING SUCH BOX

(75) Inventor: Hugh T. Cameron, Guelph (CA)

(73) Assignee: Retail Ready Packages Inc., Calgary (CA)

( * ) Notice: Subject to any disclaimer, the term of this patent is extended or adjusted under 35 U.S.C. 154(b) by 238 days.

(21) Appl. No.: 13/570,896

(22) Filed: Aug. 9, 2012

(65) Prior Publication Data

US 2014/0042216 A1 Feb. 13, 2014

(51) Int. Cl.

*B65D 5/00* (2006.01)
*B65D 5/44* (2006.01)
*B65D 5/54* (2006.01)

(52) U.S. Cl.

CPC ..... *B65D 5/443* (2013.01); *B65D 5/5405* (2013.01)

(58) Field of Classification Search

USPC ..... 229/162.1, 103.2, 240, 242, 190–198, 229/915, 918; 206/746, 774

See application file for complete search history.

(56) References Cited

U.S. PATENT DOCUMENTS

| | | | | |
|---|---|---|---|---|
| 3,162,351 | A * | 12/1964 | Rudofski | 229/122 |
| 3,660,116 | A * | 5/1972 | Clark | 206/521.1 |
| 3,777,969 | A | 12/1973 | Nurre | |
| 3,863,831 | A * | 2/1975 | Wozniacki et al. | 229/120 |
| 4,201,291 | A | 5/1980 | Davidson | |
| 5,657,872 | A | 8/1997 | Leftwich et al. | |
| 6,129,211 | A | 10/2000 | Prakken et al. | |
| 6,168,027 | B1 | 1/2001 | Esser | |
| 6,386,368 | B1 | 5/2002 | Pirro | |
| 6,478,159 | B1 | 11/2002 | Taylor et al. | |
| 7,000,824 | B2 * | 2/2006 | Saulas | 229/243 |
| 7,021,468 | B2 | 4/2006 | Cargile, Jr. | |
| 7,080,736 | B2 | 7/2006 | Jackson et al. | |
| 7,150,903 | B2 | 12/2006 | Frey | |
| 7,451,878 | B2 | 11/2008 | Rochefort et al. | |
| 7,467,743 | B1 * | 12/2008 | Philips | 229/169 |
| 7,549,542 | B2 | 6/2009 | Gasior et al. | |
| 7,784,676 | B2 | 8/2010 | Borek et al. | |
| 2008/0237070 | A1 | 10/2008 | Justice | |
| 2009/0282843 | A1 | 11/2009 | Brand | |
| 2010/0001052 | A1 | 1/2010 | Gardner | |
| 2011/0057022 | A1 | 3/2011 | Sinclair et al. | |

(Continued)

FOREIGN PATENT DOCUMENTS

| | | | |
|---|---|---|---|
| EP | 0706948 | A1 | 4/1996 |
| FR | 1501894 | A | 11/1967 |

(Continued)

OTHER PUBLICATIONS

Jervelund, European Patent Office, "Extended European Search Report", dated Jul. 6, 2011, in European Application No. 11160205.8.

(Continued)

*Primary Examiner* — Christopher Demeree
*Assistant Examiner* — Phillip Schmidt

(57) ABSTRACT

Blanks are provided for forming boxes with side supports formed from flaps extending from the front and back of the box. The side supports are on the outside of the box and are of full height, i.e., as tall as the total height of the box, or flush with the top and bottom of the box. The side supports may be double-layer supports formed by folding the flaps. Boxes having full-height side supports and processes for forming such boxes are also provided.

17 Claims, 11 Drawing Sheets

(56) References Cited

U.S. PATENT DOCUMENTS

| | | | |
|---|---|---|---|
| 2011/0240727 | A1 | 10/2011 | Cameron |
| 2012/0055922 | A1 | 3/2012 | Aksan et al. |

FOREIGN PATENT DOCUMENTS

| | | | |
|---|---|---|---|
| GB | 1147520 | A | 4/1969 |
| WO | 01/87721 | A1 | 11/2001 |

OTHER PUBLICATIONS

Jervelund, European Patent Office, Office Communication dated Nov. 5, 2012, in European Application No. 11160205.8.

Dunse, Amie, Canadian Intellectual Property Office, Office Communication dated Jun. 27, 2013, in Canadian Application No. 2,785,111.

Canadian Intellectual Property Office, Office Communication dated Sep. 12, 2013, in Canadian Application No. 2,785,111.

Extended European Search Report dated Dec. 3, 2013 issued in corresponding EP Application No. 12197057.8.

* cited by examiner

BOX WITH FULL-HEIGHT SIDE SUPPORTS AND BLANK AND PROCESS FOR FORMING SUCH BOX

FIELD

The present invention relates to boxes, and blanks and processes for forming boxes.

BACKGROUND

Cardboard or paperboard boxes are useful for shipping and storing goods or products. It is common to form such a box from a single blank. Typically, the blank has four main panels for forming the top, bottom, front and back of the box, and has side panels extending from the main panels for forming the sides of the box. The adjacent flaps are separated by wide gaps (or slots) for ease of production and assembly. Tear lines may be provided on the blank so that a portion of the box may be removed along the tear lines to convert a packaging box to a display box. Such blanks and boxes are disclosed in, for example, WO 01/87721 to Maus, and U.S. Pat. No. 7,784,676 to Borek et al. In some situations, the known blanks and boxes such as those disclosed in the above references are adequate, but in some situations, they are either not suitable, or do not provide sufficient box strength to resist deformation under an applied pressure during use.

SUMMARY

In an aspect of the present application, there is provided a blank for forming a box. The blank comprises a plurality of panels joined to one another at respective fold lines, said panels comprising a top panel for forming a box top, a bottom panel for forming a box bottom, a front panel for forming a box front and a back panel for forming a box back, each one of said panels having two side edges; and a plurality of flaps each extending from one of said side edges, for forming box sides, wherein flaps extending from said front and back panels are as tall as the total height of the box to be formed from said blank.

In another aspect of the present application, there is provided a blank for forming a box. The blank comprises a plurality of panels joined to one another at respective fold lines, said panels comprising a top panel for forming a box top, a bottom panel for forming a box bottom, a front panel for forming a box front and a back panel for forming a box back, each one of said panels having two side edges; and a plurality of flaps each extending from one of said side edges, for forming box sides, wherein flaps extending from said front and back panels are taller than said front and back panels and have ends each offset from said fold lines by at least about a thickness of said blank.

In an embodiment of a blank provided herein, a fold line may be provided on each flap extending from said front panel or said back panel, for folding the flap along said fold line to form a double-layer support. The fold line on the flap may be configured for folding the flap inward. The blank may comprise a tear line defining a removable portion in said top and front panels, for removing said portion from said box along said tear line. The blank may have a substantially uniform thickness. The flaps may be separated from one another by slits. Flaps extending from said top and bottom panels may be minor flaps. The blank may be formed of a corrugated cardboard having a flute direction substantially perpendicular to said fold lines joining said panels.

In a further aspect of the present invention, there is provided a box comprising a top, a bottom, a front, a back, and two sides each comprising a top flap extending downward from said top, a bottom flap extending upward from said bottom, a back flap extending forward from said back, and a front flap extending rearward from said front, wherein said back and front flaps are affixed to outside surfaces of said top and bottom flaps, and are as tall as the total height of said box.

In another aspect of the present invention, there is provided a box comprising a top, a bottom, a front, a back, and two sides each comprising a top flap extending downward from said top, a bottom flap extending upward from said bottom, a back flap extending forward from said back, and a front flap extending rearward from said front, wherein said back and front flaps are affixed to outside surfaces of said top and bottom flaps, and have top and bottom ends flush with said top and bottom respectively.

In an embodiment of a box provided herein, the front and back flaps may be folded inwardly to form double-layer supports. The front and back flaps may be glued to said outside surfaces of said top and bottom flaps. The box may comprise a tear-line for removing a portion of said top and a portion of said front. The top and bottom flaps may be minor flaps. The box may be formed of a corrugated cardboard, and the flute directions in said front and back flaps may be substantially vertical. The box may be formed from a blank described herein.

In a further aspect of the present invention, there is provided a process for forming a box from a blank comprising at least four panels and flaps extending from opposite edges of each one of said four panels, wherein said four panels are foldable to form a top, a bottom, a front and a back of the box. The process comprises folding flaps extending from said top and bottom to form two partial sides; and folding each flap extending from said front or back to form a side support and attaching said side support to an outside surface of a respective one of said partial sides. The blank is configured such that said side support is as tall as the total height of said box.

In another aspect of the present invention, there is provided a process for forming a box from a blank comprising at least four panels and flaps extending from opposite edges of each one of said four panels, wherein said four panels are folded to form a top, a bottom, a front and a back of the box. The process comprises folding flaps extending from said top and bottom to form two partial sides; and folding each flap extending from said front or back to form a side support and attaching said side support to an outside surface of a respective one of said partial sides. The blank is configured such that said side support has a top end flush with said top and has a bottom end flush with said bottom.

In an embodiment of a process provided herein, each flap extending from said front or back may be folded to form a double-layer side support. Attaching may comprise bonding with an adhesive. The blank may be a blank described herein.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures, which illustrate, by way of example only, embodiments of the present invention.

DETAILED DESCRIPTION

In brief overview, boxes with full-height side supports are found to be able to withstand stronger vertical compression without substantial deformation, as compared to a box with side supports or flaps that do not extend over the full height of the box. Blanks for forming boxes with full-height side supports are disclosed herein. Full-height side supports have top and bottom ends that are flush with the top and bottom of the box. In other words, the full-height side supports are as tall as the total height of the box.

Figure 1A:
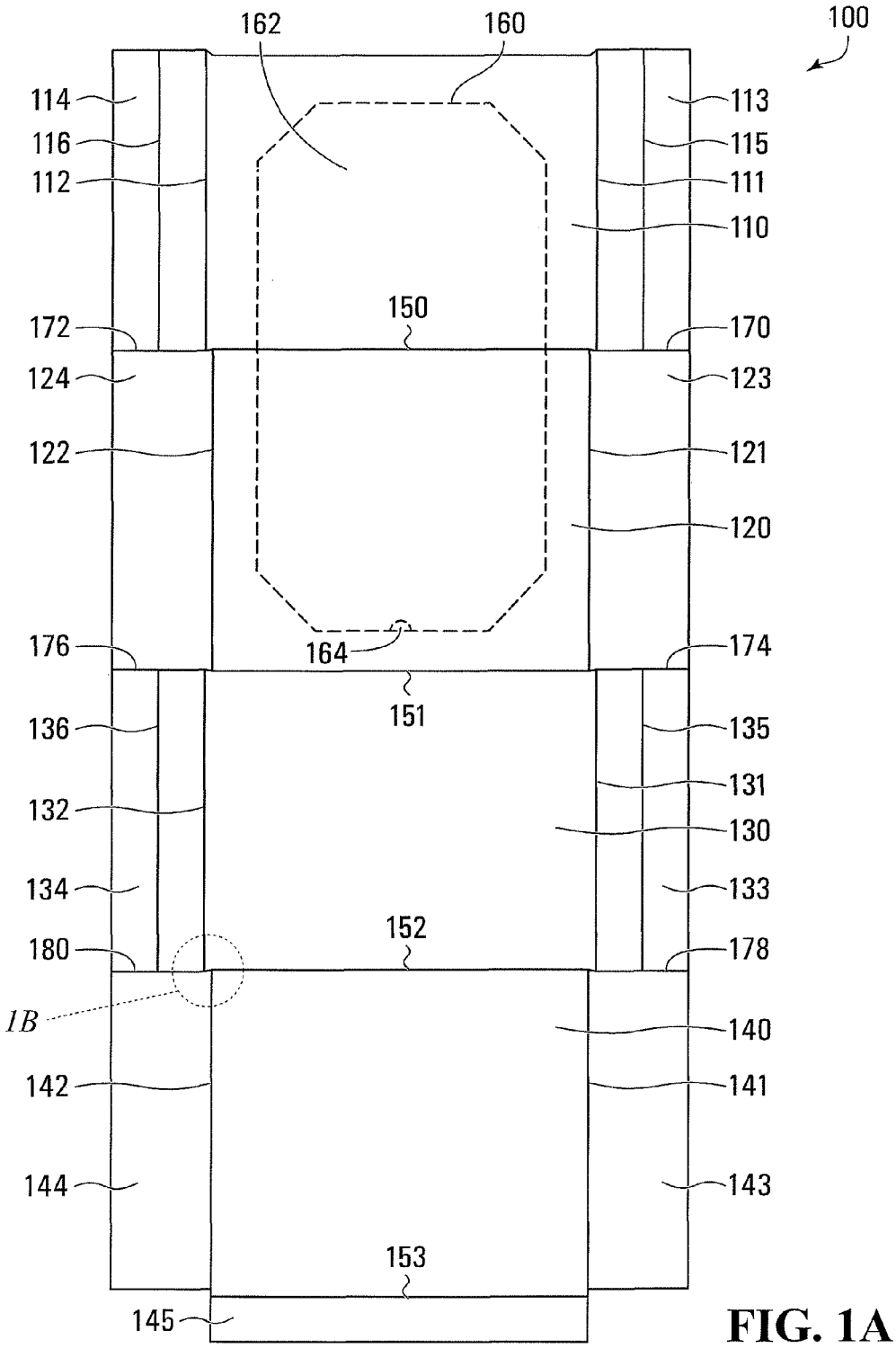
FIG. 1A is a plan view of a blank for a box, exemplary of an embodiment of the present invention.

FIG. 1A depicts a box blank 100, exemplary of an embodiment of the present invention. Blank 100 has a plurality of panels including front panel 110, top panel 120, back panel 130, and bottom panel 140, which serially extend in a direction referred to as the lengthwise or longitudinal direction herein.

The terms "lengthwise", "length", "longitudinal", "widthwise", "width", and "transversal" are used herein for ease of reference, and it should be understood that it is not necessary that the length of blank 100, or any component thereon, is longer than the corresponding width. In some embodiments, a length may be equal to or shorter than a corresponding width of the same blank or a given portion of the blank.

As depicted, each panel 110, 120, 130, 140 has two side edges 111, 112; 121, 122; 131, 132; 141, 142. A flap 113, 114, 123, 124, 133, 134, 143, or 144 extends from each respective side edge 111, 112, 121, 122, 131, 132, 141, or 142.

As depicted in FIG. 1, front panel 110 and bottom panel 140 are terminal (end) panels, but in different embodiments, box 100 may be assembled in a different orientation such that the terminal panels are the top and back panels in assembled form. Optionally, an end flap such as end flap 145 may extend from a terminal panel such as bottom panel 140, which may be used to join the ends of panels 110 and 140, and form a joint known as the manufacturer's joint.

Each flap 113, 114, 133, 134 has a fold line 115, 116, 135, 136 thereon, for folding the respect flap to form a double-layer support.

Fold lines 150, 151, 152 are provided between adjacent panels 110, 120, 130, 140 for folding panels 110, 120, 130, 140. In other words, panels 110, 120, 130, 140 are joined to one another at respective fold lines 150, 151, 152. When end flap 145 is provided, an optional additional fold line 153 may be provided for folding end flap 145.

Fold lines (not separately numbered) are also provided at side edges 111, 112, 121, 122, 131, 132, 141, and 142 between the panels 110, 120, 130, 140 and their respective flaps 113, 114, 123, 124, 133, 134, 143, and 144.

Optionally, as depicted, a tear line 160 may be provided on blank 100, which may form a closed loop enclosing a removable portion 162 of front panel 110 and top panel 120, such that removable portion 162 can be conveniently removed along tear line 160 during use. Tear line 160 may be provided by way of a tear strip.

The shape, size, and position of the loop formed by tear line 160 are not necessarily as shown in FIG. 1A and may vary in different embodiments, depending on which portion of the resulting box should be removed. For example, the shape, size and position of the tear-line loop may be selected to meet requirements or balance factors such as ease of display and access, and maintaining box integrity during use. Multiple tear lines may also be used for removing a portion of the resulting box for these purposes.

For convenience of removing removable portion 162, a notch portion 164 may be optionally provided at a convenient location along tear line 160. For example, it may be convenient to position notch portion 164 on top panel 120 as shown in FIG. 1A. More than one notch portions may also be provided in different embodiments. For ease of use, notch portion 164 may be pre-cut or partially severed (such as by a score line as depicted) so that it can be pushed out easily by a user using a finger.

As is typical for blanks used to form packaging boxes, the widths of front and back panels 110, 130 are substantially the same, the lengths of front and back panels 110, 130 are substantially the same, the widths of top and bottom panels 120, 140 are substantially the same, and the lengths of top and bottom panels 120, 140 are substantially the same, so that the resulting box will have a substantially rectangular or cubic shape. Boxes with a substantially rectangular or cubic shape may be convenient to handle and store in many situations.

The widths of flaps 123, 124, 143, 144 extending from top and bottom panels 120, 140 may also be substantially equal, and these flaps may be minor flaps. As used herein, minor flaps refer to flaps that do not meet in the middle in the formed box, as shown in FIGS. 1C-1D. As depicted, there is a gap between each pair of flaps 123, 143, and 124, 144. In comparison, major flaps refer to flaps that can meet in the middle of the formed box. To provide minor flaps, the width of each flap 123, 124, 143, 144 may be less than half of the length of front and back panels 110, 130. Minor flaps 123, 124, 143, 144 are provided to form partially open sides of box 190.

For reasons that will become clear below, in the present embodiment, the length of flaps 113, 114, 133, 134 is longer than the length of front and back panels 110, 130, such as by about twice the blank thickness. A difference in length between flaps 113, 114, 133, 134 and front and back panels 110, 130 is necessary to provide side supports that are flush with the top and bottom of the resulting box as will be further described below. In cases where a blank has a varying thickness, the skilled person should be able to adjust the difference between the lengths of flaps 113, 114, 133, 134 and panels 110, 130 in view of the present disclosure to achieve a similar result.

Further, the width of front and back panels 110, 130 is wider than the width of top and bottom panels 120, 140, such as by about four times of the blank thickness. This difference in width allows flaps 123, 124, 143, 144 to be folded inside and fit between the top and bottom of the box to be formed, as can be appreciated by those skilled in the art.

In the present embodiment, to provide the necessary width difference between front and back panels 110, 130 and top and bottom panels 120, 140, and length difference between flaps 113, 114, 133, 134 and panels 110, 130, side edges 111, 112, 131, 132 are transversely offset from side edges 121, 122, 141, 142, such as by about twice of the blank thickness, and each pair of adjacent flaps 113, 114, 123, 124, 133, 134, 143, 144 is severed and separated by a slit cut 170, 172, 174, 176, 178, or 180, which is longitudinally offset from the respective fold line 150, 151, 152, such as by about the box thickness. That is, each slit 170, 172, 174, 176, 178, or 180 is offset from the closest one of fold lines 150, 151, 152 by about the box thickness. In other words, the end of each flap is offset from all fold lines 150, 151, 152 by at least about the box thickness.

A slit cut is a cut where little material is removed by the cut and the adjacent flaps may still be in contact with one another after the slit cut, or there may be only a narrow gap between the adjacent flaps after the slit cut. With such slit cuts, the adjacent flaps 113, 114, 123, 124, 133, 134, 143, 144 are severed from one another but may still abut each other, as depicted in FIG. 1A and better shown in the enlarged intersection of slit cut 180, side edges 132, 142, and fold line 152 in FIG. 1B.

Figure 1B:
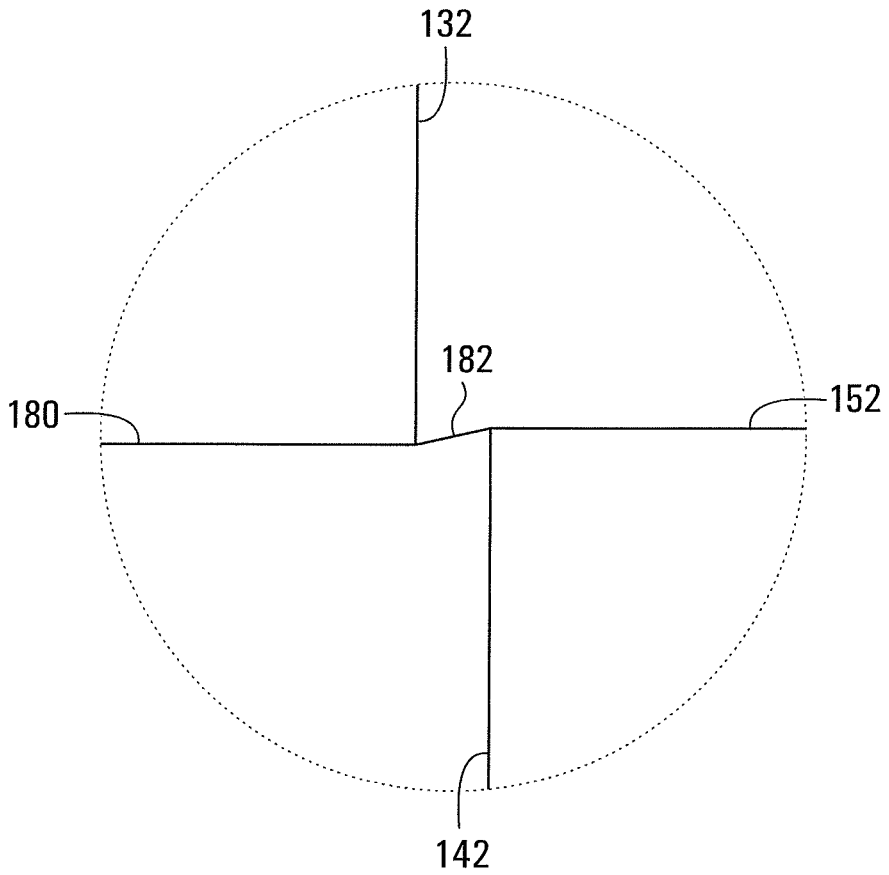
FIG. 1B is an enlarged view of the portion 1B of the blank of FIG. 1A.
Figure 1C:
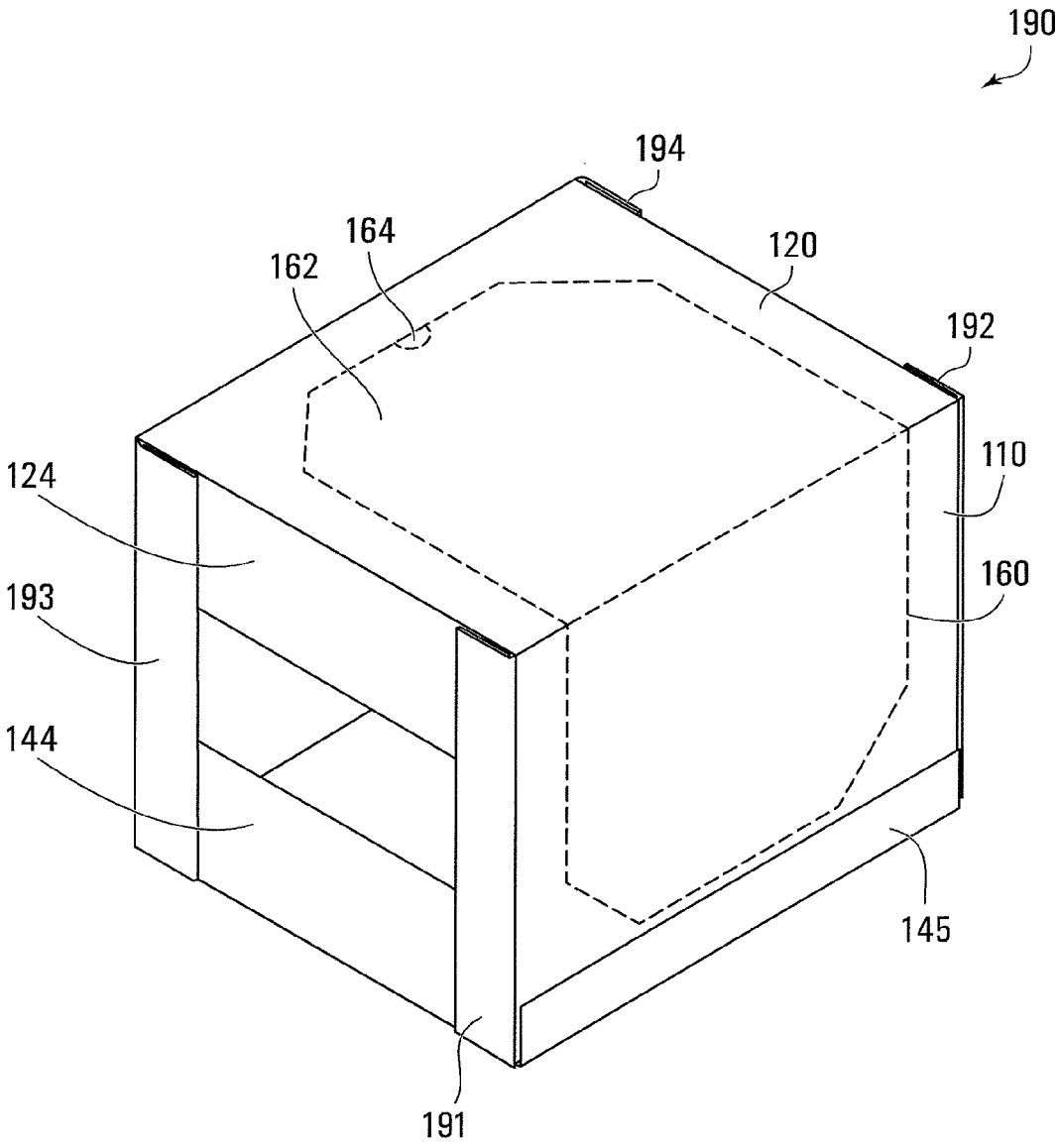
FIG. 1C is a perspective view of a box formed from the blank of FIG. 1A, exemplary of an embodiment of the present invention.
Figure 1D:
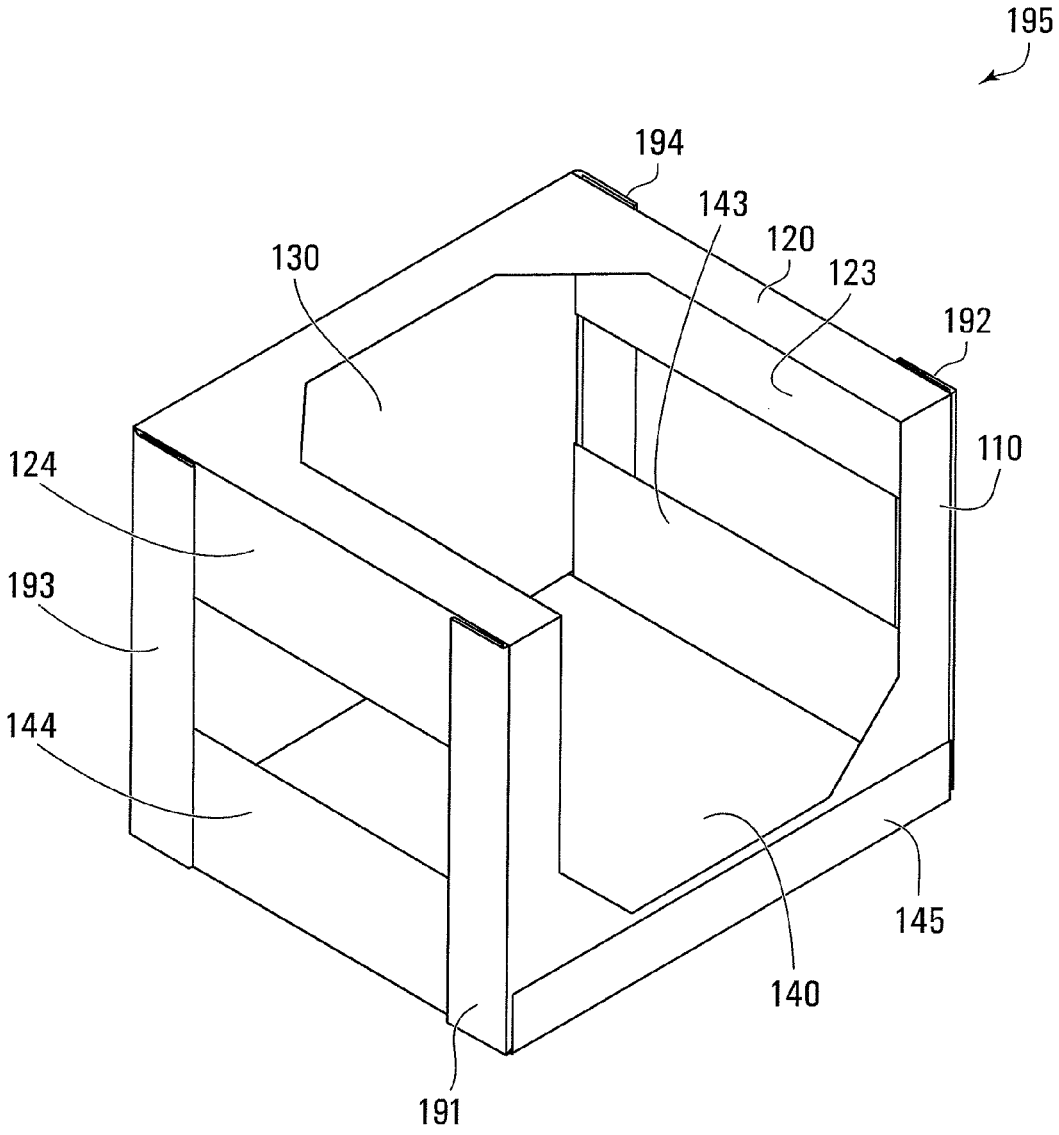
FIG. 1D is a perspective view of a display box formed from the box of FIG. 1C by removing a portion thereof, exemplary of an embodiment of the present invention.

As illustrated in FIG. 1B, to offset slit 180 from fold line 152, and offset side edge 132, from side edge 142, a small portion 182 of slit cut 180 is slanted with respect to fold line 152 and side edges 132, 142. The offset between slit 180 and fold line 152 may be about half of the offset between side edges 132, 142. The offsets may be designed to provide close fit between the respective panels and flaps in the resulting box.

Slit cuts allow the provision of flaps 113, 114, 133, 134 that are taller than the height of panels 110, 130, and at the same time flaps 123, 124, 143, 144 that can extend the full length between the front and back of the resulting box. As can be appreciated, when flaps 123, 124, 143, 144 extend over the full length between the box front and back, they can improve or reinforce box integrity, and provide support when the box front and back are compressed towards one another.

In comparison, wider cuts sometimes referred to as slots in the literature are used in known blanks, as exemplified in WO 01/87721 to Maus and U.S. Pat. No. 7,784,676 to Borek et al., where the adjacent flaps are separated by a wide gap. With such wide gaps between the flaps as shown in these references, the length of each flap is shorter than, or equal to, the length of the panel to which the flap is attached.

Blank 100 may be formed of any suitable material for box blanks and packaging boxes. For example, corrugated boards, cardboard, paper board, fibreboard, or plastics may be used. Suitable material may include double faced corrugated cardboard. Other materials typically used for forming shipping or packaging boxes may be used. When a corrugated board is used to form blank 100, the flute direction of the corrugated board may be substantially parallel to the lengthwise direction of blank 100, or substantially parallel to fold lines 150, 151, 152, so that the flute direction in the sides of the box to be formed is substantially vertical.

Glues or other adhesive materials or suitable configurations for attaching or fixing different parts of blank 100 may be additionally provided at the appropriate locations on blank 100, if desired. In particular, glues or other adhesive materials may be applied to some or all of flaps 113, 114, 123, 124, 133, 134, 143, 144 and 145, as will be further discussed below.

Blank 100 may have any suitable thickness and size. As noted earlier, Blank 100 may have a substantially uniform thickness. In some embodiments, blank 100 may have a thickness from about 1 mm to about 5 mm. In a particular embodiment, blank 100 may have a thickness of about 3 or about 4 mm.

Blank 100 may be folded into a box 190, as illustrated in FIG. 1C, in selected embodiments. A box packing machine may be used to fold blank 100 and package box 190.

In selected embodiments, panels 110, 120, 130, 140 and end flap 145 may be first folded along fold lines 150, 151, 152, 153 to form a tube shape. End flap 145 and a portion of front panel 110 may overlap and may be glued together, or otherwise attached to each other. For example, a hot melt adhesive may be used and may be applied using, for example, a hot glue gun.

Optionally, goods (not shown) to be packaged within the box, may be inserted into the tube from one or both of the open sides at this time.

Flaps 123, 124, 143, 144 extending from top and bottom panels 120, 140 are then folded inwardly along fold lines at side edges 121, 122, 141, 142, to form partial sides.

Next, flaps 113, 114, 133, 134 extending from front and back panels are folded inwardly along fold lines 115, 116, 135, 136 and glued or otherwise bonded to form double-layer supports 191, 192, 193, 194. Double-layer supports 191, 192, 193, 194 are then folded inwardly along fold lines at side edges 111, 112, 131, 132, and glued or otherwise attached to the outside surfaces of respective partial sides formed by flaps 123, 124, 143, 144. This completes the formation of sides of box 190, and thus box 190.

Box 190 thus has a front formed from front panel 110, a top formed from top panel 120, a back formed from back panel 130, a bottom formed from bottom panel 140, and partially open sides formed from flaps 113, 114, 123, 124, 133, 134, 143, 144.

As now can be understood, the length of each flap 113, 114, 133, 134 is the height of the corresponding support 191, 192, 193, 194 when box 190 is in the up-right position. The length of front and back panels 110, 130 is also their height when box 190 is in the up-right position. Thus, in this disclosure, for convenience of reference, the length of each flap 113, 114, 133, 134 and front and back panels 110, 130 may also be interchangeably referred to as its height.

As illustrated in FIG. 1C, because the height of flaps 113, 114, 133, 134 is taller than the height of front and back panels 110, 130 and is appropriately selected, the top end of each side support 191, 192, 193, and 194 is flush with the top of box 190, and the bottom end of each side support 191, 192, 193, and 194 is flush with the bottom of box 190. It is to be understood that a top end of a side support is flush with the top of box 190 when it is substantially flush with the top surface of box 190 provided the top surface is substantially flat. Similarly, a bottom end of a side support is flush with the bottom of box 190 when it is substantially flush with the bottom surface of box 190 provided the bottom surface is substantially flat. The ends (or edges) of the side supports are considered flush with the top and bottom respectively as long as when the box is under vertical compression, the side supports 191, 192, 193, and 194 bear at least part of the applied load before box 190 substantially deforms under the vertical compression.

A vertical compression may be applied during assembly, packaging, shipping, storage, or unpacking. For example, when a machine is used to form and package the box, a vertical compression may need to be applied by the machine during the packaging process. When boxes are stacked for storage or transportation, a vertical compression may also be applied on the lower boxes.

Conveniently, side supports 191, 192, 193, and 194 provide improved vertical support and resistance against deformation under vertical compression, as compared to boxes without full-height side supports.

As can be appreciated, when a corrugated board is used to form blank 100 and hence box 190, and the flute direction is substantially parallel to the lengthwise direction of blank 100, the flute direction (not shown) in the front, back and the side supports of box 190 as depicted in FIG. 1C would be substantially vertical. Conveniently, such an orientation of the flute direction can provide increased vertical strength, as compared to other orientations of the flute direction.

Conveniently, double-layered supports provide improved resistance against vertical compression, as compared to a single layer side support that is of the same material and thickness. To provide even stronger support, side-supports may be formed with three or more layers, such, as by further folding flaps 113, 114, 133, 134. In some embodiments, however, single layer side supports may be sufficient, depending on the particular application and use.

For example, stronger side supports 191, 192, 193, and 194 may be required when flaps 123, 124, 143, 144 are sized such that there are gaps between them when they are folded to form partial sides of the box. In comparison, if flaps 123 and 143 abut or overlap with each other and flaps 124 and 144 abut or overlap with each other in the formed box, some side support can be provided by 123, 124, 143, 144. However, such a configuration will require more blank material and increase the weight of the blank and the box. Further, with such a configuration, the sides of the box are closed by the overlapping flaps, so that the content of the box is not visible from the side. In some applications, it may be desirable to be able to view the content in the box from the sides.

Also conveniently, when side supports 191, 192, 193, and 194 are attached to the outside surfaces of flaps 123, 124, 143, 144, the internal space in box 190 can have a substantially regular shape, so that it may be convenient to package goods or products that have regular individual shapes, such as bars. In comparison, if side supports, such as folded side supports, are provided inside flaps 123, 124, 143, 144, the internal space in the box would be irregular due to protrusions formed by the side supports.

When two overlapping portions are to be attached, the overlapping portions may be glued, or may be stapled, taped, or otherwise attached or affixed together.

As noted above, the goods (not shown) to be packaged may be placed inside box 190 before the sides of box 190 are closed and sealed.

The partial openings on the sides of box 190 may allow partial viewing of the goods, and may reduce the materials needed to form box 190. However, the openings should be shaped and sized to prevent the goods from falling out of box 190.

Box 190 with the contained goods may then be transported or stored. For example, box 190 with the contained goods may be conveniently placed on a storage or display shelf.

Box 190 may be opened by tearing off removable portion 162 along tear line 160. When notch portion 164 is provided, the user may push off notch portion 164 first and insert a finger into the resulting notch opening to facilitate tearing off and removal of portion 162.

The remainder of box 190 forms a display box 195 with partially opened top and front, as shown in FIG. 1D. Therefore, the goods (not shown) placed in box 190 become accessible and visible in box 195. It is not necessary to remove the goods from box 190 or display box 195 to place them on the shelf, to view them, or to access them. A user can conveniently remove the goods from the partially open box 190, either from the open front side or the open top.

Figure 2A:
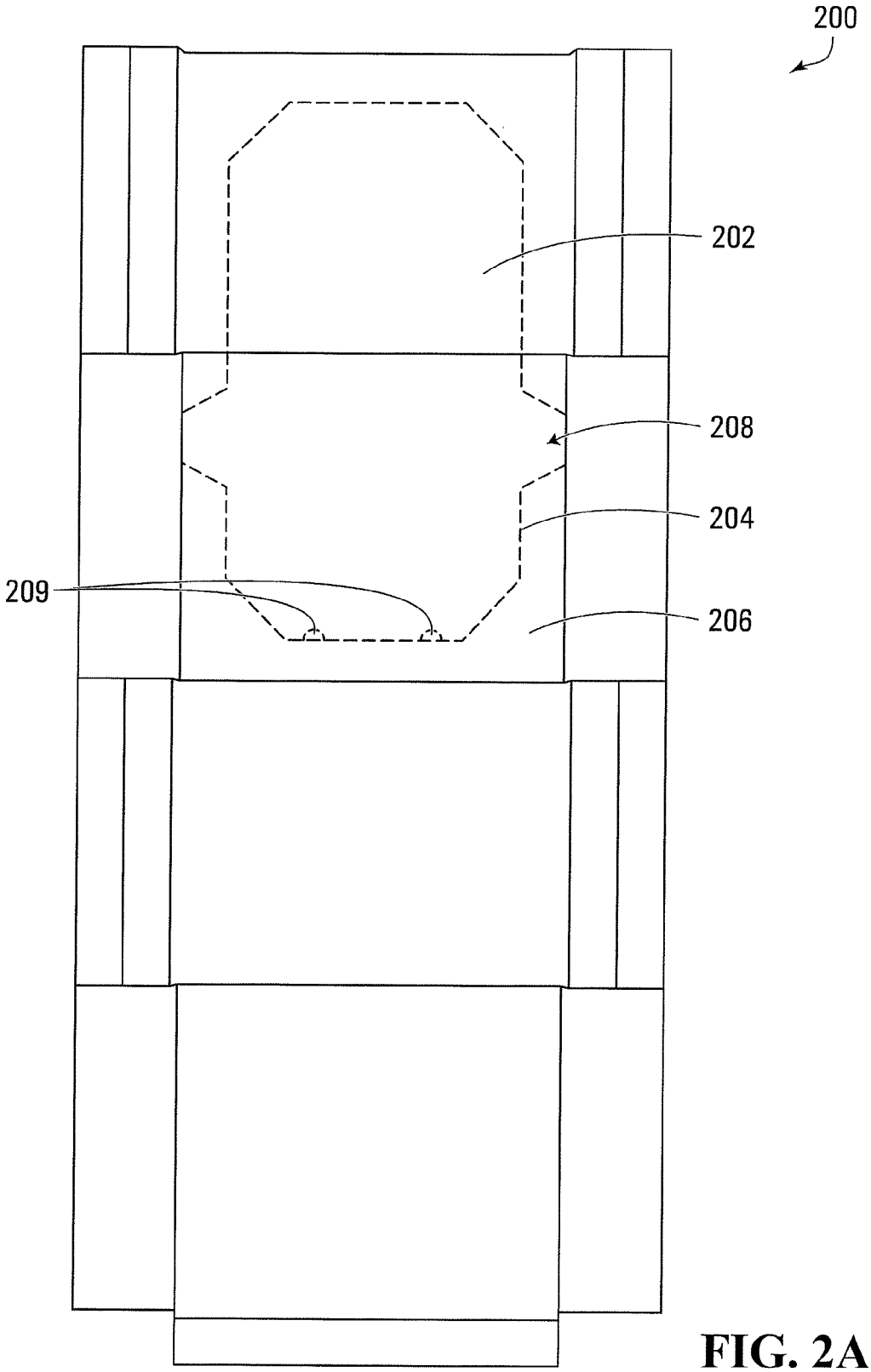
FIG. 2A is a plan view of another blank for a box, exemplary of an embodiment of the present invention.
Figure 2B:
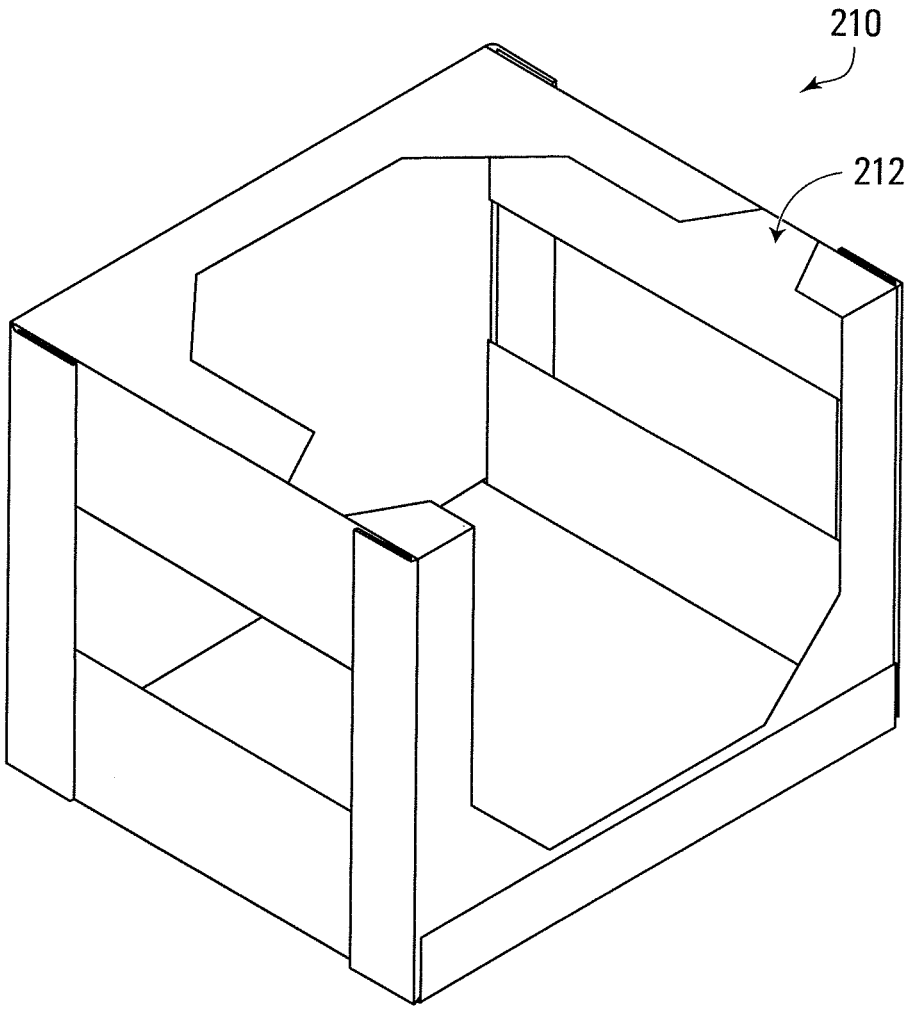
FIG. 2B is a perspective view of a box formed from the blank of FIG. 2A, exemplary of an embodiment of the present invention.

In some embodiments, a portion of the top opening or front opening may be widened, such as to the full width of the box to allow easier removal of goods from the display box. An example box blank 200 and a corresponding display box 210 are shown in FIGS. 2A and 2B. With the exception of the shape of the tear line and the removable portion, box blank 200 is otherwise similar to box blank 100, and display box 210 can be formed from blank 200 in a similar process as described above for forming display box 195 from blank 100. The removable portion 202 is defined by a tear line 204 and has a widened portion 208 in the top panel 206. The widened portion is of the full width of top panel 206 such that in display box 210, the top opening 212 has a portion that spans the full width of the box to allow easy removal of goods, particularly goods of regular shapes and goods which have a length that is about the full width of the box 210.

A further optional difference in blank 200 is that two notch portions 209 (as compared to one notch portion 164 in blank 100) may be provided as depicted.

In a specific embodiment, the dimensions in blank 100 or 200 may be as shown in Table I.

TABLE I

Example Blank Dimensions

| Component | Size (inches) Width | Length |
|---|---|---|
| Blank (overall) | 23.44 | 54.874 |
| Front and back panels | 15.94 | 9.061 |
| Top and bottom panels | 15.31 | 17.501 |
| Flaps on front and back panels | 1.78 + 1.97 = 3.85 | 9.155 |
| Flaps on top and bottom panels | 4.06 | 17.376 |
| End flap | 15.31 | 1.781 |
| Removable portion | 12.56 | 19.56 |
| widened portion of Removable portion | 15.31 | |

In some embodiments, a relatively large portion of the top and front of the box can be removed, and as a result, relatively large items may be stored in the box on a shelf and may be conveniently displayed and removed from display box 195 or 210.

As can be appreciated, when only a portion of the front and the top of box 195 or 210 is removed, the remaining portions connected to the back and side supports, can together conveniently provide structural support for confining the goods on display.

When side openings are provided in the box such as box 190, the side openings may be conveniently utilized to handle the box, and to provide a viewing window for viewing the content in box 190 without opening it. Further, less material is needed as compared to a box with fully covered sides. Conveniently, the design of blank 100 allows the openings to be formed during assembly, without having to form openings in blank 100 during fabrication of the blank. The size and position of the openings may be conveniently adjusted by adjusting the sizes of the flaps.

Further, as depicted, blank 100 or 200 as a whole may be substantially rectangular. As such, it is easier to produce and waste of material is limited during production, as compared to production of blanks that have irregular shapes and varying widths along their lengths.

In an exemplary embodiment, blank 100, 200 or other blanks described herein may be formed using various different types of known methods and systems for forming such blanks, appropriately adapted to form the features disclosed herein.

For example, the making of a blank from a corrugated fibreboard material can start with first forming a sheet of corrugated material using a corrugator machine, such as one provided by BHS Corrugated, Maschinen-und Anlagenbau GmbH™. The corrugator machine may produce a length of corrugated material of a given width that can be used immediately or stored in a roll until it is ready to be utilized.

The next step may involve utilizing a roll or sheet of such corrugated material that may have an approximate width that may be the same as the width of the desired blank that may be used to form the box. The roll or sheet can be also cut transversely such as to create sections of cardboard that are generally rectangular in shape. The corrugated material may then be fed through what is known as a flexo-folder gluer machine. In passing through such a machine, the corrugated sheet may pass through a printer, which prints words or pictures on one or both sides of the sheet. Next, the material may be creased both across and along the sheet material such that when the blank is folded/erected it may easily bend along the crease (fold) lines to form the desired shape.

The creased sheet may then be slit with a cut device which cuts thin slits in the board at designed intervals along desired directions. These slits create flaps that may be folded.

Finally, the sheet material may go through a rotary die cutter to remove excess corrugated material along one end of the board and crush down a portion along a fold line, to create a thin "hinge". The purpose of the hinge is to later allow the board to be doubled back on itself (i.e. glue one end of the board to the other to create a tube) and glued.

At some stage of this process, a tear line may be formed in the blank such as by applying a device to create perforations in the blank. For example, a steel die may be pre-applied to a part of the blank to form the perforations.

The result up to this point can be a flat blank. Thereafter a flexo-folder gluer may apply glue to appropriate portions on the blank. The panels of the blank are then folded over by a folding mechanism such that one end of the blank is now glued to the other in a flattened tube-shaped orientation to create a flat tubular shaped blank.

After the tubular shaped blank has been created, it may be grouped with other blanks and shipped to another location where the boxes are to be erected and packed.

When it is desired to fill a box with one or more products, a two step operation may be required. First, the box can be erected from its knock-down configuration, either by hand or using a "case erector" machine. Examples of commercially available case erectors include case packers made by iPak Machinery Ltd.™

The second step may be the placing of the products into the formed case, either by hand or using a "case packer" machine. Examples of commercial case packers include case packers made by iPak Machinery Ltd.™ of Canada. The box can then be sealed with the products inside.

It may also be possible to utilize blanks that have not been formed into tubular forms in a first step, but rather using flat blanks and a wrap around machine. An example of a commercial wrap around machine is available from CERMAX™ of France. The wrap around machine, utilizing a flat blank, may place one or more products on one panel and then cause the remaining panels to be folded around and glued in sequence.

As can be understood, blank 100 or 200 may be modified without losing all of its benefits.

For example, a tear line may be provided by a tear strip, or in another suitable form. A tear line may refer to any line or elongated portion in the blank that is configured or adapted to facilitate the removal of a portion of the blank. Tear lines may be provided in the form of tear-away or tear-out strips, pull strips, tear- or pull-away tabs, perforation lines such as punch-out perforation lines, score lines, thinned or weakened strips or sections, or the like.

Figure 3A:
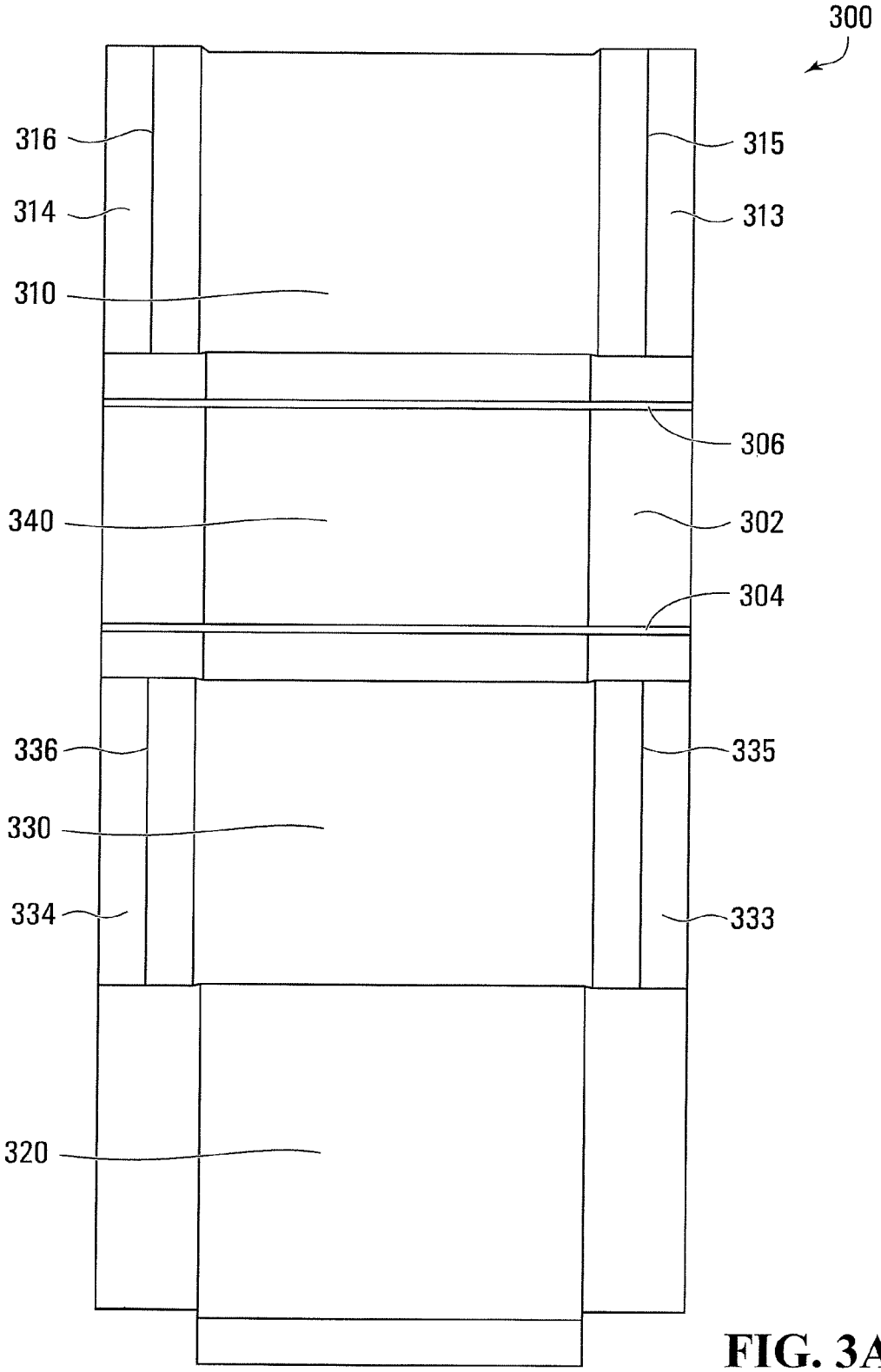
FIG. 3A is a plan view of a further blank for a box, exemplary of an embodiment of the present invention.

FIG. 3A depicts a modified box blank 300, exemplary of another embodiment of the present invention.

Blank 300 shown in FIG. 3A is similar to blank 100 or 200, except that front panel 310 and bottom panel 320 are terminal panels, and a removable portion 302 is provided by two separate tear lines 304 and 306, which as depicted may be provided as tear strips. Panel 330 is the back panel and panel 340 is the top panel. As in blank 100, side flaps 313, 314, 333 and 334 attached to front and back panels 310 and 330 are provided with fold lines 315, 316, 335 and 336 respectively and are taller than front and back panels 310 and 330.

Figure 3B:
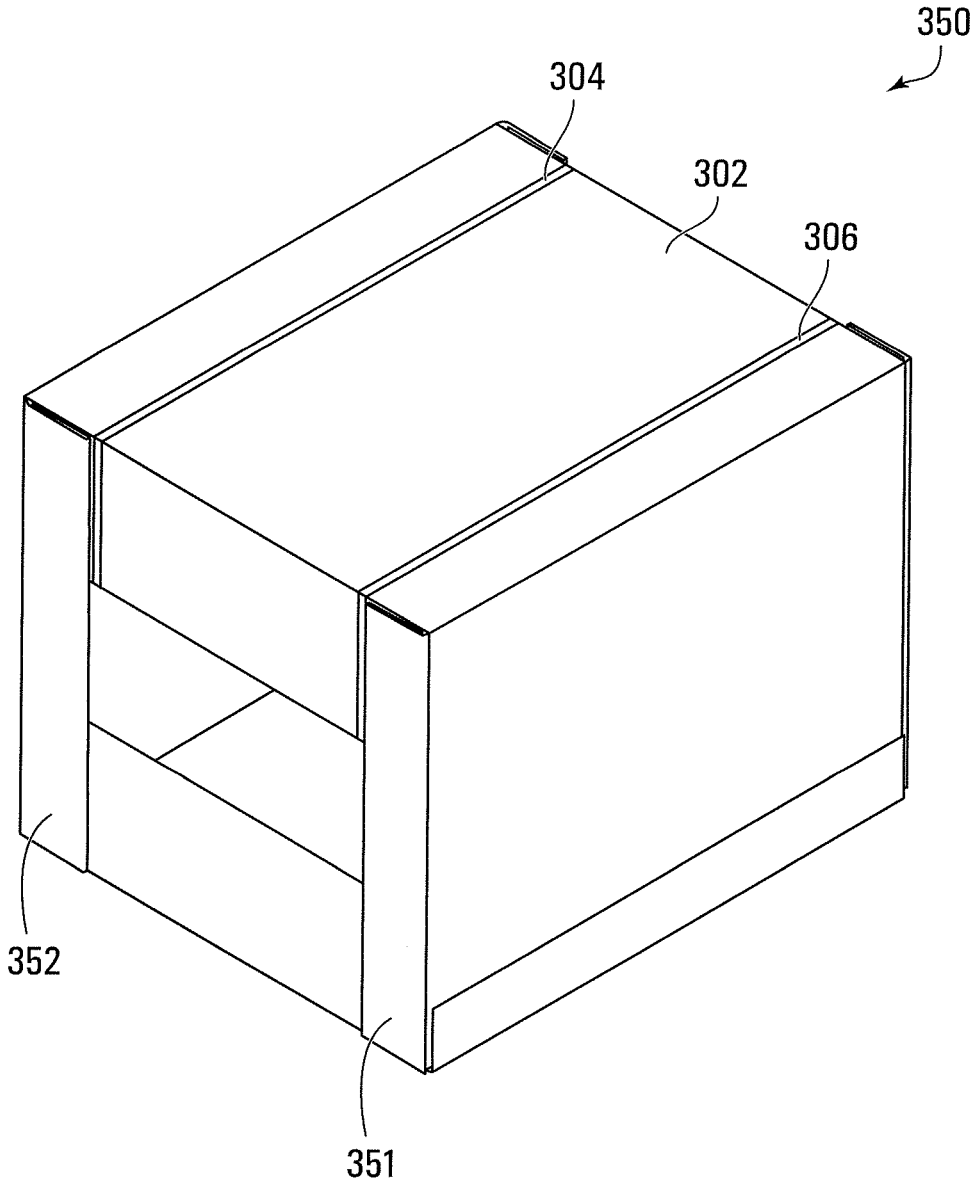
FIG. 3B is a perspective view of a box formed from the blank of FIG. 3A, exemplary of an embodiment of the present invention.
Figure 3C:
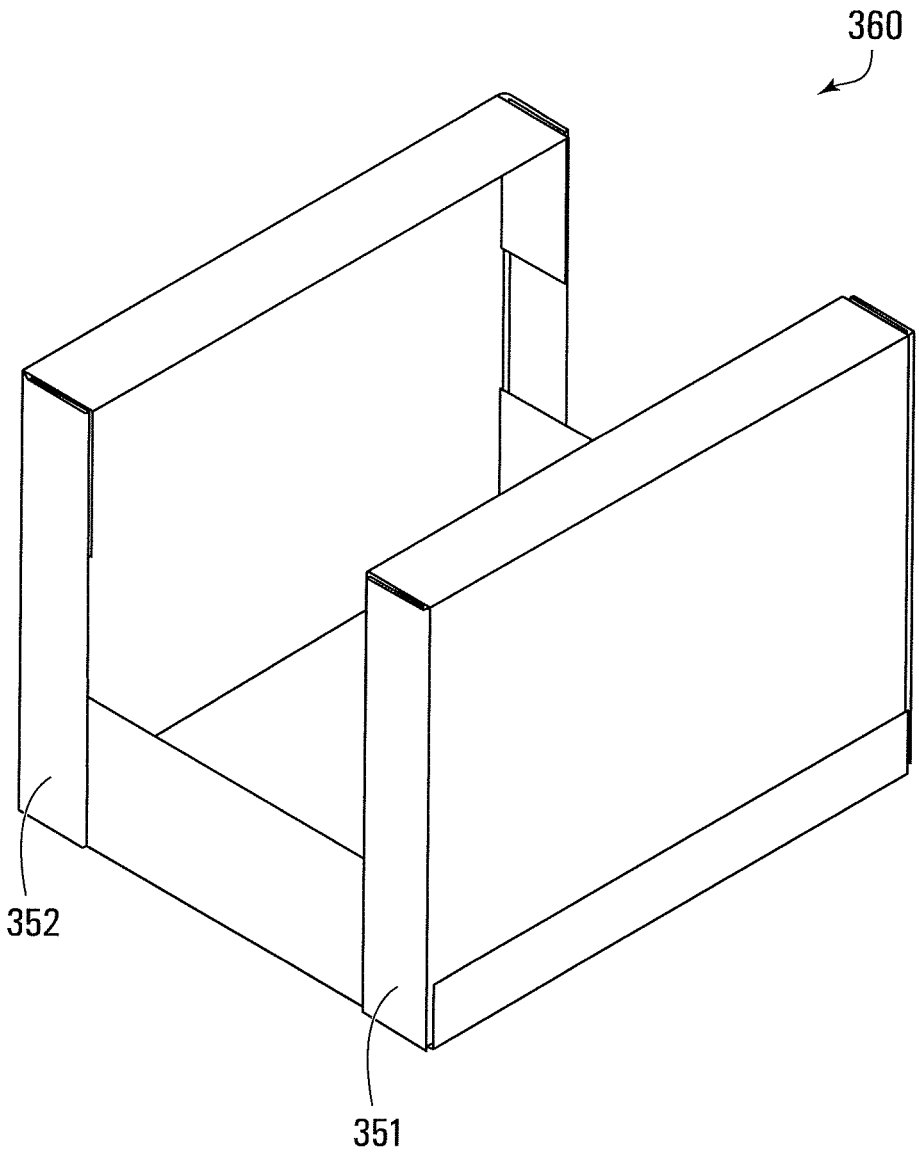
FIG. 3C is a perspective view of a display box formed from the box of FIG. 3B by removing a portion thereof, exemplary of an embodiment of the present invention.

Blank 300 may be folded to form a box 350 as illustrated in FIG. 3B, and then transformed to display box 360 as illustrated in FIG. 3C by removing the removable portion 302 along tear lines 304 and 306, in a similar manner as for forming box 190 and display box 195 or 210 from blank 100 or 200. As in box 190 or display box 195 or 210, in box 350 and display box 360, double-layer side supports, such as supports 351 and 352, are formed from side flaps 313, 314, 333 and 334, and the side supports such as supports 351 and 352 are of the same height as the total height of the box. As illustrated in FIG. 3B, the top end of each side support such as side support 351 or 352 is flush with the top of box 350, and the bottom end of each side support is flush with the bottom of box 350.

Figure 4A:
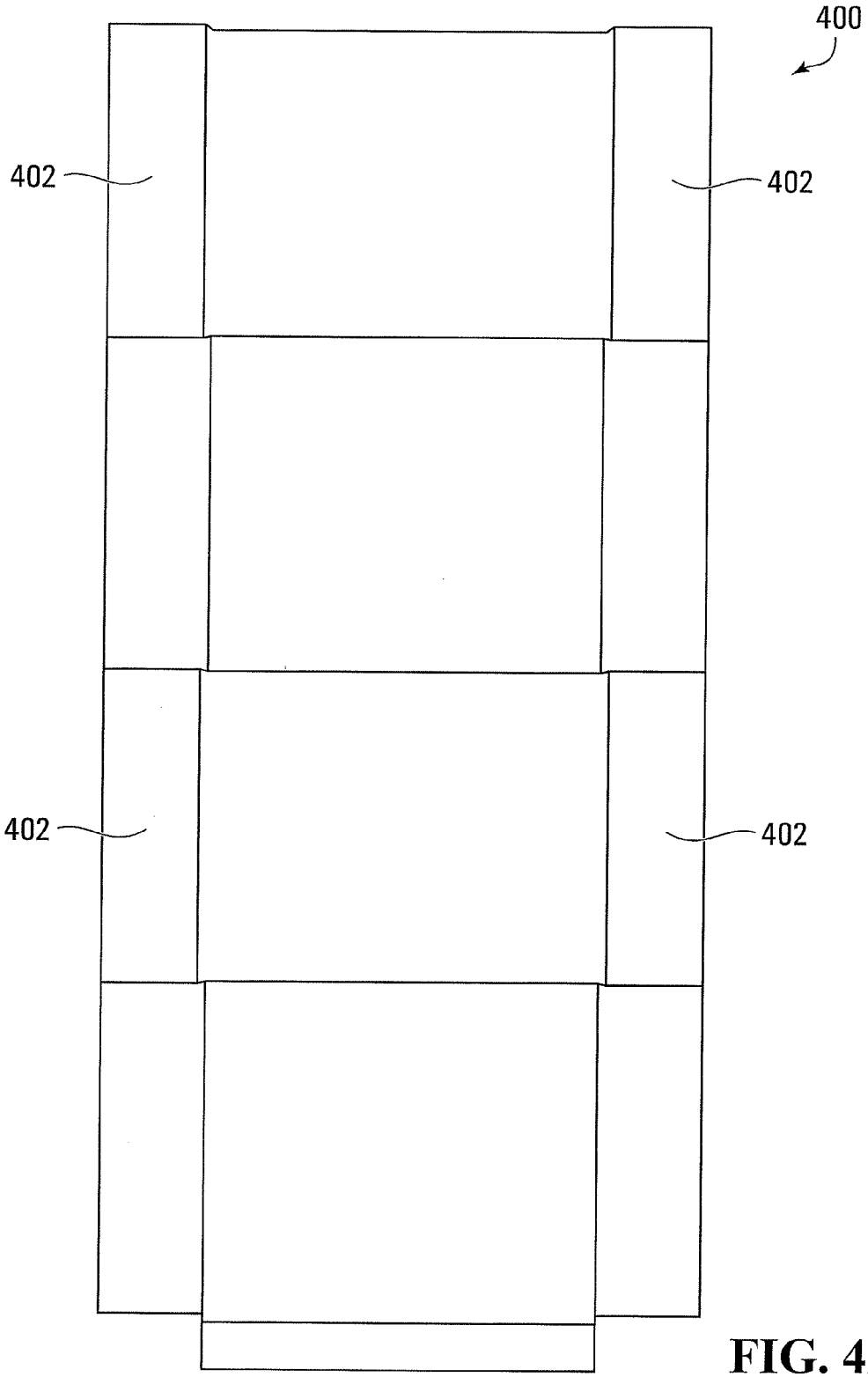
FIG. 4A is a plan view of a further blank for a box, exemplary of an embodiment of the present invention.
Figure 4B:
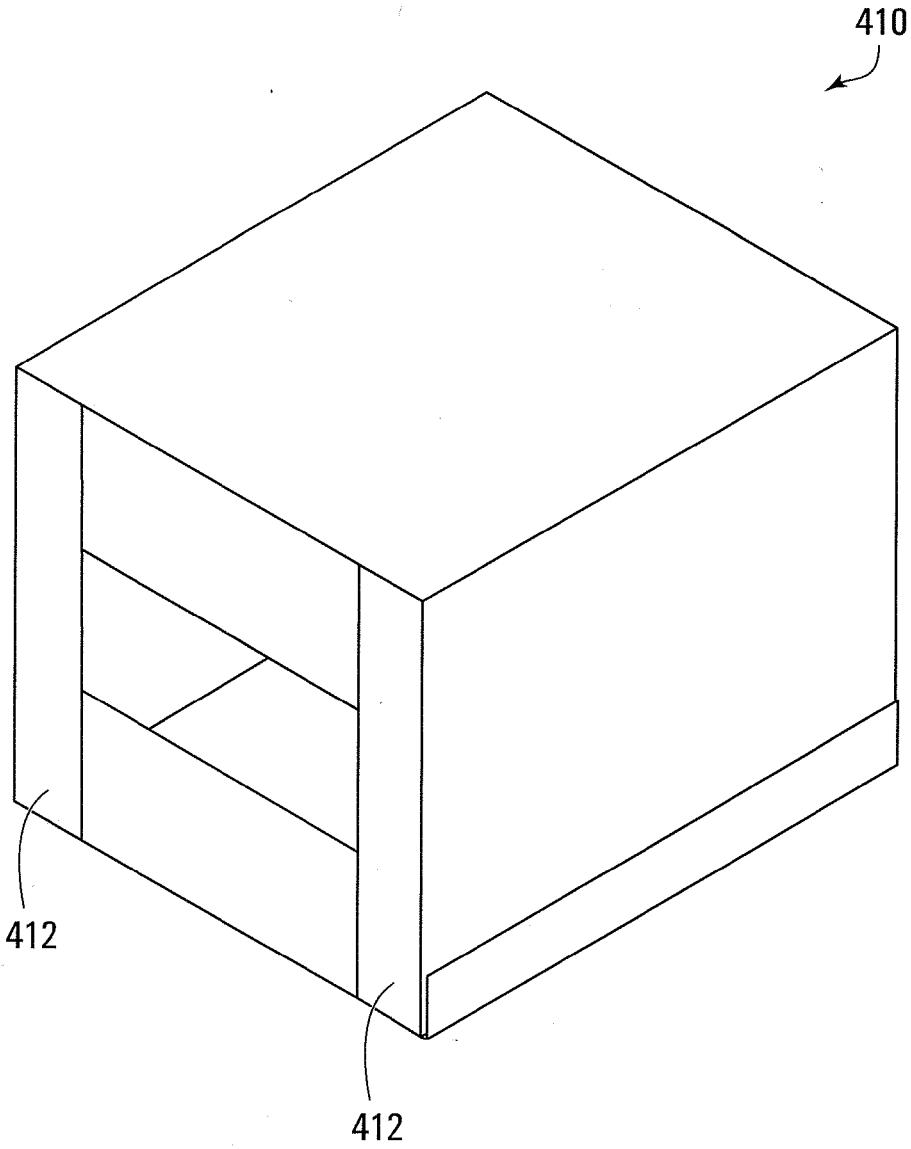
FIG. 4B is a perspective view of a box formed from the blank of FIG. 4A, exemplary of an embodiment of the present invention.

FIG. 4A depicts another modified box blank 400, exemplary of another embodiment of the present invention. Blank 400 shown in FIG. 4 is similar to blank 100, except that no fold lines are provided on the side flaps 402 for forming side supports and no tear lines are provided for removing a portion of the box. Blank 400 may be folded to form a box 410 as illustrated in FIG. 4B, in a similar manner as for forming box 190 from blank 100 with the exception that no side flaps 402 are double folded and the resulting side supports such as supports 412 are single layer supports. As depicted in FIG. 4B, in box 410 formed from blank 400, side supports 412 are still full-height supports, as in box 190.

Conveniently, as illustrated above, a shipping and display container may be formed from a single blank according to exemplary embodiments disclosed herein. Thus, the manufacture and assembly process may be simplified as compared to boxes that are formed from multiple pieces of blanks. However, in different embodiments, additional components or attachments may be added to the blanks or assembled boxes, if desired.

As can be understood, the panels in the blank are typically substantially rectangular, as depicted in the drawings. The flaps may also be substantially rectangular, as depicted in the drawings. However, in different embodiments, one or more of the flaps and panels may have a different shape. For example, one or more flaps extending from the top and bottom panels may have a curved terminal edge.

One or more permanent openings may also be provided in one or more of the panels and flaps of the blanks for various purposes depending on the application.

It will also be understood that the word "a" or "an" is intended to mean "one or more" or "at least one", and any singular form is intended to include plurals herein.

It will be further understood that the term "comprise", including any variation thereof, is intended to be open-ended and means "include, but not limited to," unless otherwise specifically indicated to the contrary.

When a list of items is given herein with an "or" before the last item, any one of the listed items or any suitable combination of two or more of the listed items may be selected and used.

Of course, the above described embodiments are intended to be illustrative only and in no way limiting. The described embodiments are susceptible to many modifications of form, arrangement of parts, details and order of operation. The invention, rather, is intended to encompass all such modification within its scope, as defined by the claims.

What is claimed is:

1. A blank for forming a box, comprising:

a plurality of panels joined to one another at respective fold lines, said panels comprising a top panel for forming a box top, a bottom panel for forming a box bottom, a front panel for forming a box front and a back panel for forming a box back, each one of said panels having two side edges; and a plurality of flaps each extending from one of said side edges, for forming box sides, wherein flaps extending from said front and back panels are as tall as a total height of the box to be formed from said blank before the box is deformed under vertical compression, or taller than said front and back panels and have ends each offset from said fold lines by at least about a thickness of said blank.

2. The blank of claim 1, wherein a fold line is provided on each flap extending from said front panel or said back panel, for folding said each flap along said fold line to form a double-layer support.

3. The blank of claim 2, wherein said fold line on said each flap is configured for folding said each flap inward.

4. The blank of claim 1, comprising a tear line defining a removable portion in said top and front panels, for removing said portion from said box along said tear line.

5. The blank of claim 1, wherein said blank has a substantially uniform thickness.

6. The blank of claim 5, wherein said flaps are separated from one another by slits.

7. The blank of claim 1, wherein flaps extending from said top and bottom panels are minor flaps.

8. The blank of claim 1, wherein said blank is formed of a corrugated cardboard having a flute direction substantially perpendicular to said fold lines joining said panels.

9. A box comprising:

a top, a bottom, a front, a back, and two sides each comprising a top flap extending downward from said top, a bottom flap extending upward from said bottom, a back flap extending forward from said back, and a front flap extending rearward from said front, wherein said back and front flaps are affixed to outside surfaces of said top and bottom flaps, and before said box is deformed under vertical compression said back and front flaps are as tall as a total height of said box, or have top and bottom ends flush with said top and bottom respectively.

10. The box of claim 9, wherein said front and back flaps are folded inwardly to form double-layer supports.

11. The box of claim 9, wherein said front and back flaps are glued to said outside surfaces of said top and bottom flaps.

12. The box of claim 9, comprising a tear-line for removing a portion of said top and a portion of said front.

13. The box of claim 9, wherein said top and bottom flaps are minor flaps.

14. The box of claim 9, wherein said box is formed of a corrugated cardboard, and the flute directions in said front and back flaps are substantially vertical.

15. A process for forming a box from a blank comprising at least four panels and flaps extending from opposite edges of each one of said four panels, wherein said four panels are foldable to form a top, a bottom, a front and a back of the box, said process comprising:

folding flaps extending from said top and bottom to form two partial sides; and folding each flap extending from said front or back to form a side support and attaching said side support to an outside surface of a respective one of said partial sides, wherein said blank is configured such that before said box is deformed under vertical compression said side support is as tall as a total height of said box, or has a top end flush with said top and has a bottom end flush with said bottom.

16. The process of claim 15, wherein said each flap extending from said front or back is folded to form a double-layer side support.

17. The process of claim 15, wherein said attaching comprises bonding with an adhesive.

* * * * *